US011761616B1

(12) United States Patent
Wang et al.

(10) Patent No.: US 11,761,616 B1
(45) Date of Patent: Sep. 19, 2023

(54) POWER SUPPLY BASE FOR DECORATIVE LAMP

(71) Applicant: TAIZHOU HAIRUI DECORATION LIGHTS CO.LTD., Zhejiang (CN)

(72) Inventors: Hailang Wang, Zhejiang (CN); Di Huang, Zhejiang (CN)

( * ) Notice: Subject to any disclaimer, the term of this patent is extended or adjusted under 35 U.S.C. 154(b) by 0 days.

(21) Appl. No.: 17/991,625

(22) Filed: Nov. 21, 2022

(30) Foreign Application Priority Data

Nov. 3, 2022 (CN) ..... 202222922100.2

(51) Int. Cl.

| | |
|---|---|
| ***F21V 23/00*** | (2015.01) |
| ***F21V 21/002*** | (2006.01) |
| ***F21V 31/00*** | (2006.01) |
| ***F21V 23/06*** | (2006.01) |
| ***H01R 13/625*** | (2006.01) |

(52) U.S. Cl.
CPC ..... *F21V 23/002* (2013.01); *F21V 21/002* (2013.01); *F21V 23/06* (2013.01); *F21V 31/005* (2013.01); *H01R 13/625* (2013.01)

(58) Field of Classification Search
None
See application file for complete search history.

(56) References Cited

U.S. PATENT DOCUMENTS

| | | | | |
|---|---|---|---|---|
| 11,339,963 | B1 * | 5/2022 | Lambesis | F21S 2/005 |
| 2015/0159844 | A1 * | 6/2015 | Flaherty | F21S 4/10 362/249.02 |

FOREIGN PATENT DOCUMENTS

| | | | | |
|---|---|---|---|---|
| CN | 104930369 | A | 9/2015 | |
| CN | 106402811 | A | 2/2017 | |
| CN | 211952527 | U | 11/2020 | |
| CN | 212841209 | U | 3/2021 | |
| DE | 102013209533 | A1 * | 11/2014 | H01R 13/5205 |

* cited by examiner

*Primary Examiner* — Anne M Hines

(57) ABSTRACT

Disclosed is a power supply base for a decorative lamp. A female plug is mounted, in a mounting chamber of a base, a terminal of the female plug is located in a cavity of the base and is connected to a power supply in the cavity, and exposed wires are all hidden in the cavity of the base, so that current is introduced to the decorative lamp mounted above the power supply base, thereby achieving, the free plugging and unplugging of the decorative lamp and the power supply base. The present invention has the advantages of simple structure, reasonable design, convenient use and the like, thereby improving the safety.

7 Claims, 8 Drawing Sheets

POWER SUPPLY BASE FOR DECORATIVE LAMP

FIELD OF TECHNOLOGY

The present invention relates to the technical field of decorative lamps, and in particular to a power supply base for a decorative lamp.

BACKGROUND

In order to set off the festive atmosphere, people often decorate the environment at festivals and activities, and various decorative lamps are essential props. The decorative lamps are powered to emit different colors of light, or the decorative lamps can form different shapes to create a festive atmosphere.

However, in the actual layout process of the decorative lamps, a large number of disorganized wires are the biggest headache for stylists. Taking tree lights as an example, there are many branches on each tree light, and each branch needs to lead out a wire for power supply. The exposed wires not only affect the ornamental effect, but also are prone to wire damage, leading to a potential safety hazard.

Therefore, how to effectively solve the problem of exposure of a large number of wires of the decorative lamps has become an urgent problem to be solved.

SUMMARY

In view of this, the present invention provides a power supply base for a decorative lamp so as to solve the problem of exposure of a large number of wires in decorative lamps in the past which affects the ornamental effect, and the problem of potential safety hazard caused by that the exposed wires are prone to damage.

The technical solution provided by the present invention is specifically as follows: a power supply base for a decorative lamp includes: a base, a female plug and a male plug;

a cavity is formed in an interior of the base, a downward recessed mounting groove is formed in an upper surface of the base, a through hole communicating with the cavity of the base is formed in a bottom surface of the mounting groove, a panel extending upward is arranged along a circumferential direction of the through hole, and the mounting chamber is surrounded by the panel;

the female plug is mounted in the mounting chamber, and a terminal of the female plug passes through the through hole, is located in the cavity of the base and is used for being connected to a power supply; and an upper part of the male plug is mounted at the bottom of the decorative lamp, and a lower part of the male plug is movably inserted in the female plug and is electrically connected to the female plug.

Preferably, a limiting plate extending downward is arranged along the circumferential direction of the through hole on a bottom surface of the mounting groove, the limiting plate has a connecting end and a free end, first positioning hole channels are symmetrically formed on the limiting plate, each of the first positioning hole channels is composed of a first guiding hole channel and a first locking hole channel, the first guiding hole channel is linear, is arranged along an extending direction of the limiting plate, and penetrates through the free end of the limiting plate, and the first locking hole channel is arranged vertically relative to the first guiding hole channel and extends along a circumferential direction of the limiting plate; and first limiting blocks fitted with the first positioning hole channels are symmetrically arranged on an outer side wall of the female plug.

Further preferably, the male plug includes: a male plug main body and a connecting sleeve;

the connecting sleeve includes a connecting part and a locking part which are integrally connected to each other;

the connecting part is a column-shaped cylinder with a closed upper end and an open lower end, and a through hole penetrating up and down is formed in a closed end face of the upper end of the connecting part;

the locking part is a column-shaped cylinder with open upper and lower ends, the locking part and the through hole in the connecting part are coaxially arranged, the lower end of the locking part is fixedly connected to the closed end face of the upper end of the connecting part, second positioning hole channels are symmetrically formed in a side wall of the locking part, each of the second positioning hole channels is composed of a second guiding hole channel and a second locking hole channel which communicate with each other, the second guiding hole channel is linear, is arranged along a height direction of the locking part, and penetrates through the upper end of the locking part, and the second locking hole channel is arranged vertically relative to the second guiding hole channel and extends along a circumferential direction of the locking part; and the male plug main body is embedded in the locking part, and second limiting blocks fitted with the second positioning hole channels are symmetrically arranged on an outer side wall of the male plug main body.

Further preferably, a convex edge extending outward along a radial direction is arranged at the periphery of the male plug main body, the convex edge is located between a plug pin of the main plug main body and the second limiting blocks, and a diameter of the convex edge is greater than a diameter of the through hole in the closed end face of the upper end of the connecting part and is less than a diameter of the connecting part.

Further preferably, the connecting part in the connecting sleeve is provided with a waterproof edge extending upward.

Further preferably, locking blocks protruding outward along a radial direction are symmetrically arranged on an outer side wall of the connecting part in the connecting sleeve; and positioning slideways fitted with the locking blocks are symmetrically arranged on a side wall of the mounting groove in the base, each of the positioning slideway is composed of a guiding slideway and a locking slideway which communicate with each other, the guiding slideway is linear, is arranged along a height direction of the mounting groove, and penetrates through an upper edge of the mounting groove, and the locking slideway is arranged vertically relative to the guiding slideway and extends along a circumferential direction of the mounting groove.

Further preferably, a sealing pad is arranged in an interior of the connecting part in the connecting sleeve; and when the connecting sleeve is sleeved outside the male plug main body, the sealing pad is located between the closed end face of the upper end of the connecting part and the convex edge of the male plug main body.

According to the power supply base for the decorative lamp provided by the present invention, the connection mode of the male plug and the female plug is applied to the power supply base of the decorative lamp, the female plug is mounted in the mounting chamber of the base, the terminal of the female plug is located in the cavity of the base and is connected to the power supply in the cavity, all exposed wires in the past are hidden in the cavity of the base, the upper part of the male plug is mounted at the bottom of the decorative lamp, the lower part of the male plug is movably inserted into the female plug and is electrically connected to the female plug, current in the female plug is introduced to the decorative lamp above the power supply base, and the decorative lamp and the power supply base can be plugged and unplugged freely.

The power supply base for the decorative lamp provided by the present invention has the advantages of simple structure, reasonable design, convenient use and the like, and can hide the disorganized wires in the existing decorative lamp inside, so that the decorative lamp is more beautiful and can better protect the wires, and the safety is improved.

It should be understood that the above general description and the following detailed description are only exemplary and explanatory, and cannot limit the present invention.

BRIEF DESCRIPTION OF THE DRAWINGS

The drawings of the specification that constitutes a part of the present application are used to provide a further understanding of the present invention. The exemplary embodiments of the present invention and the description thereof are used to explain the present invention, and do not constitute an improper limitation of the present invention. In the drawings:

the accompanying drawings herein are incorporated into the specification and constitute a hole channel part of the specification, show embodiments consistent with the present invention, and are used to explain the principle of the present invention together with the specification.

To describe the technical solutions in the embodiments of the present invention or in the prior art more clearly, the drawings required for describing the embodiments or the prior art are described briefly below. Obviously, other drawings can be obtained by those of ordinary skill in the art based on these drawings without creative efforts.

Figure 1:
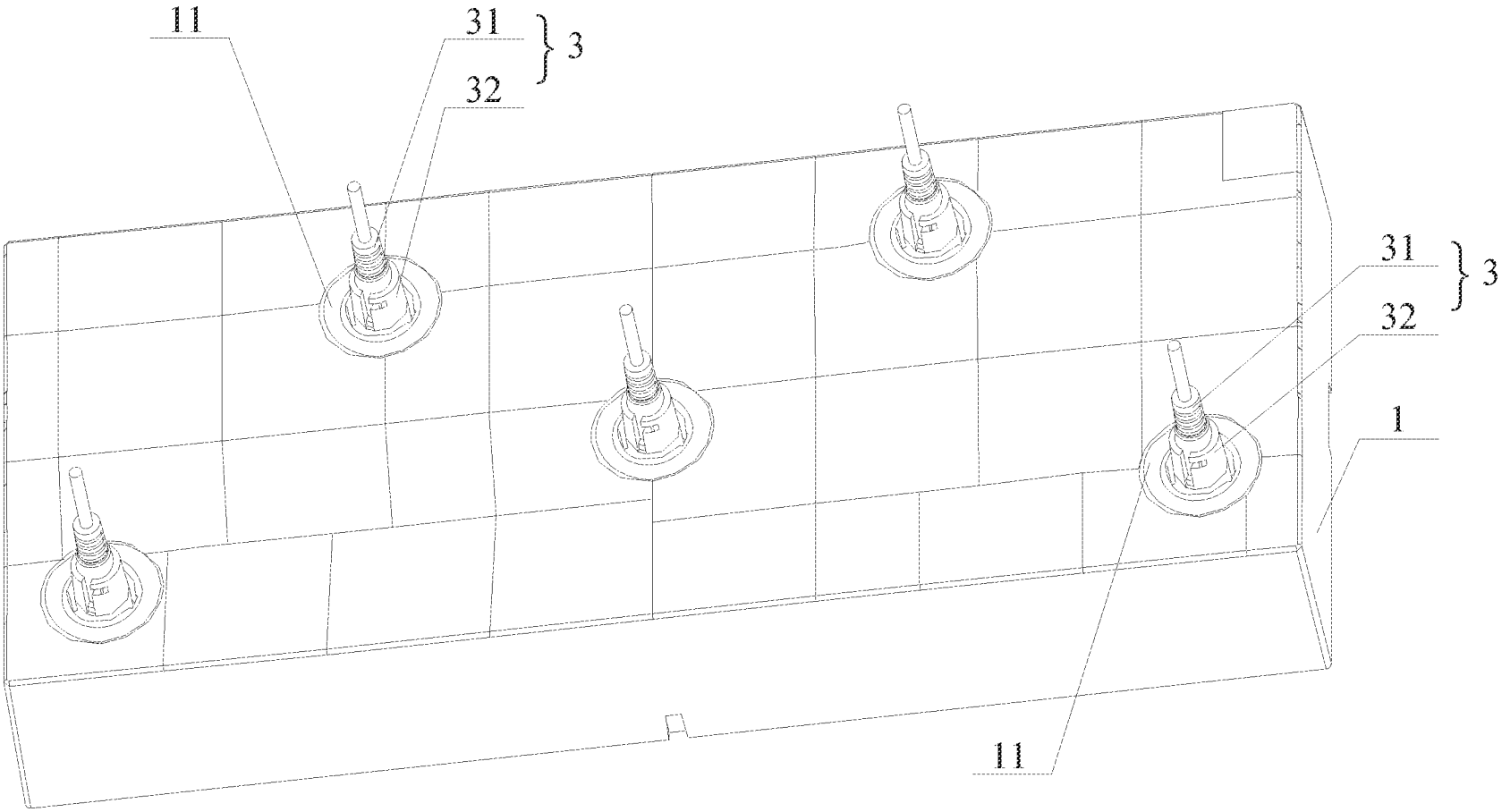
Figure 2:
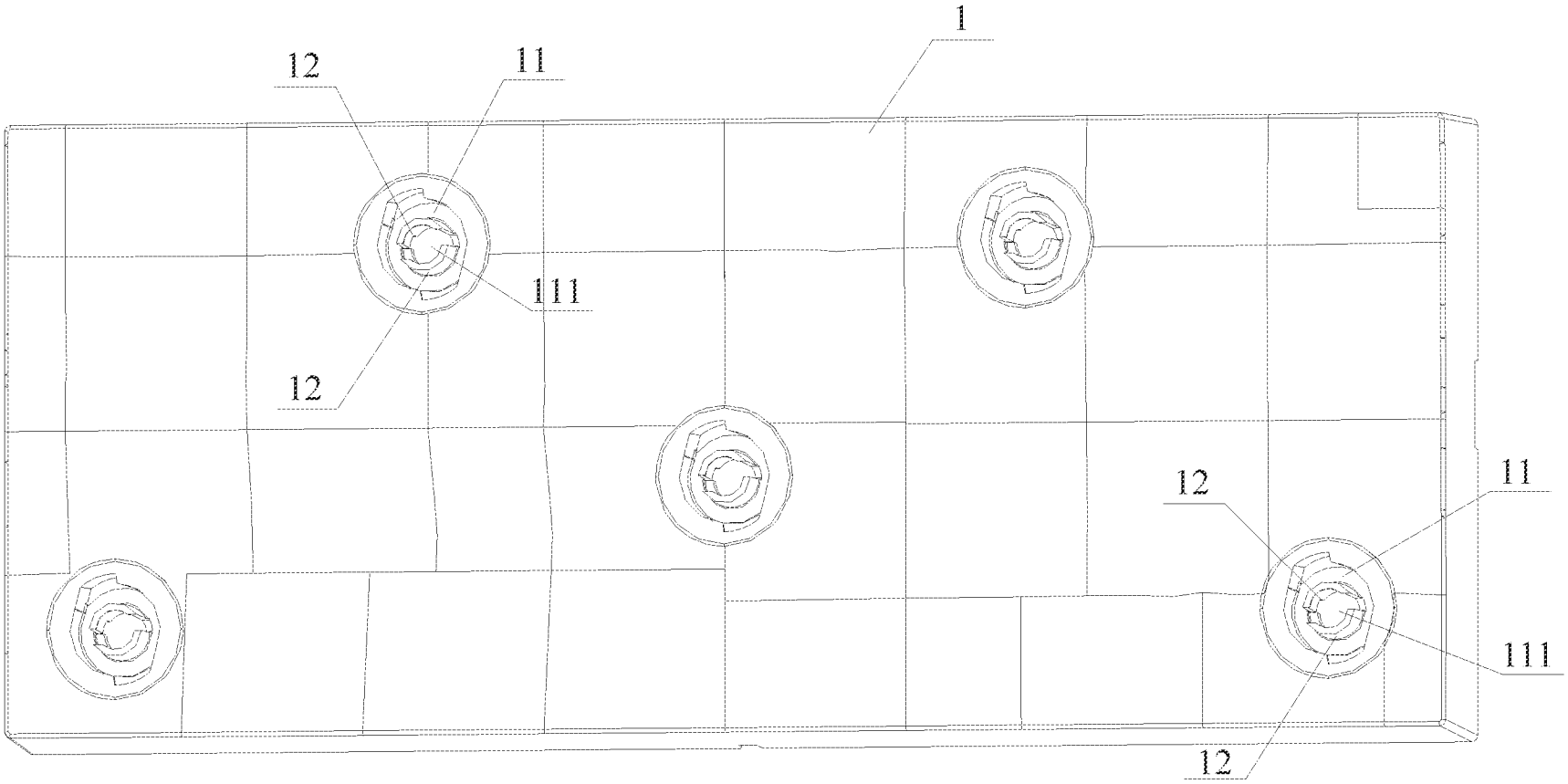
Figure 3:
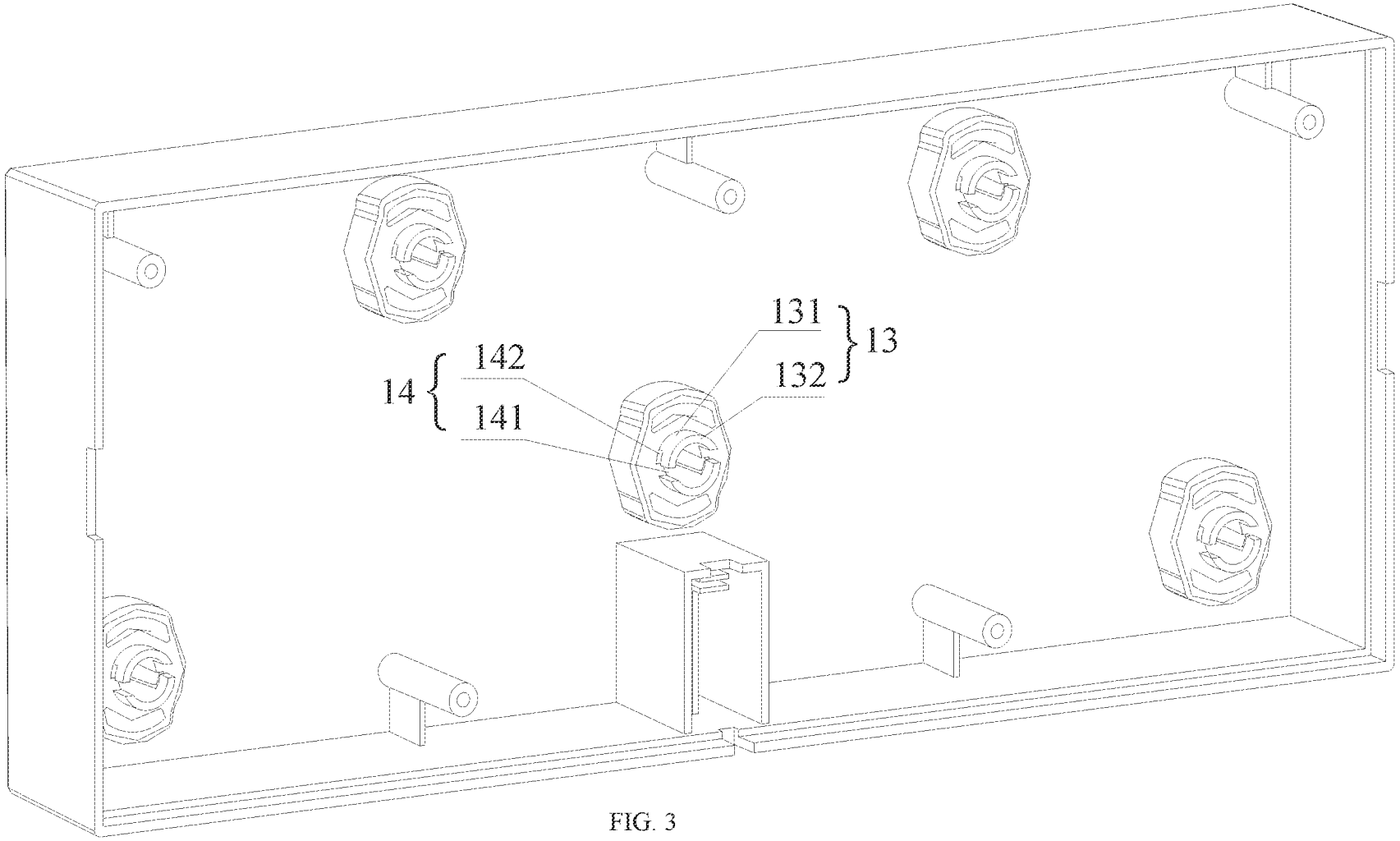
Figure 4:
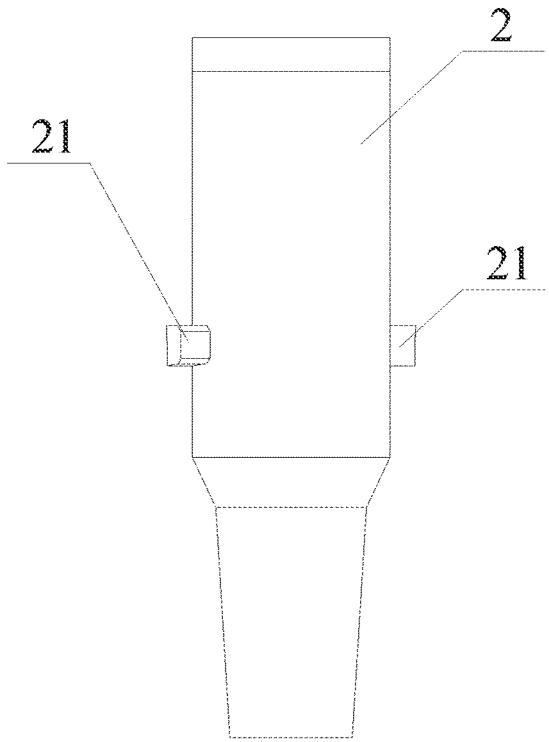
Figure 5:
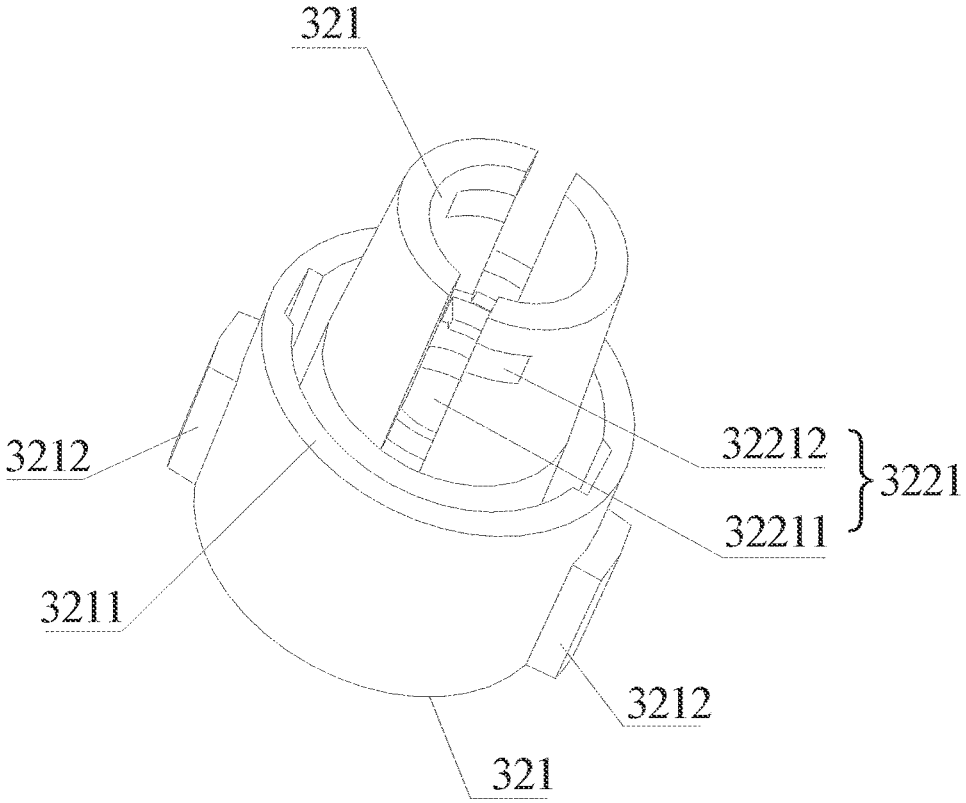
Figure 6:
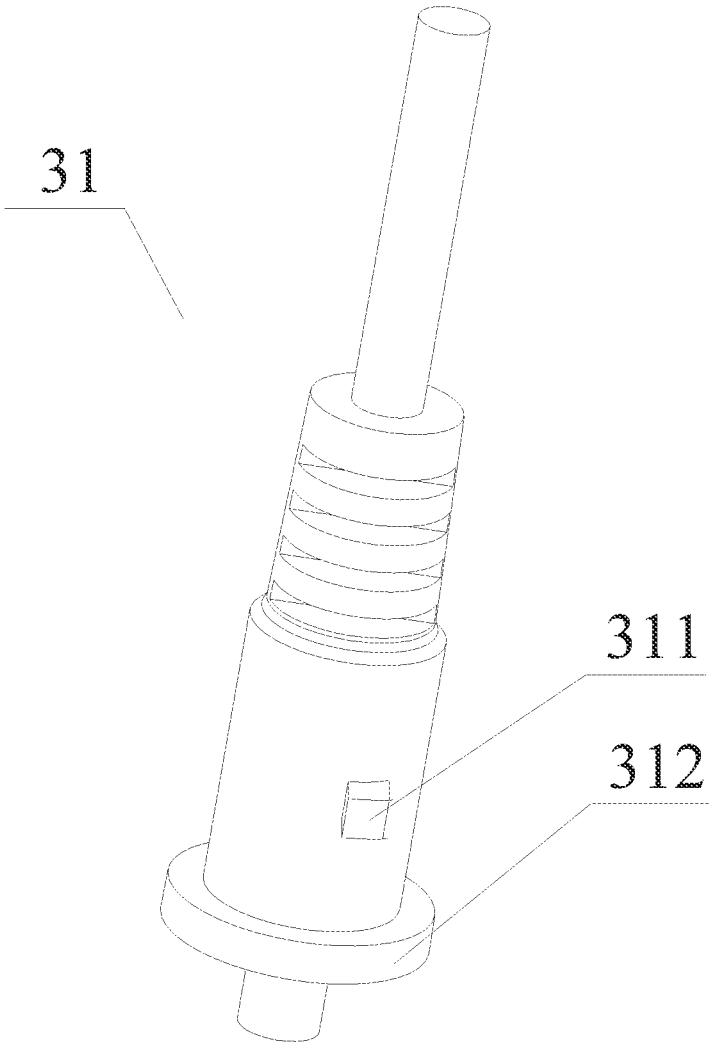
Figure 7:
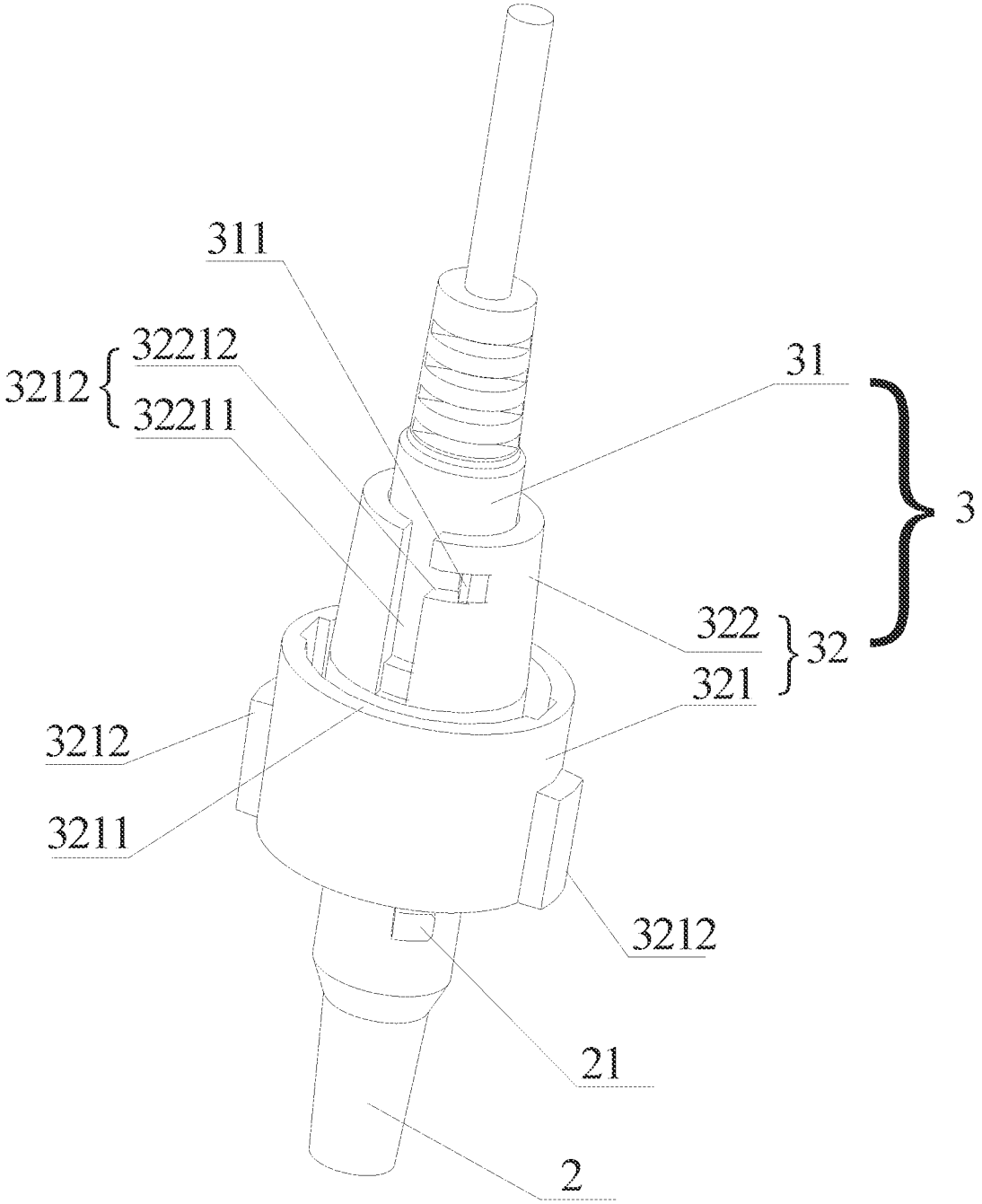
Figure 8:
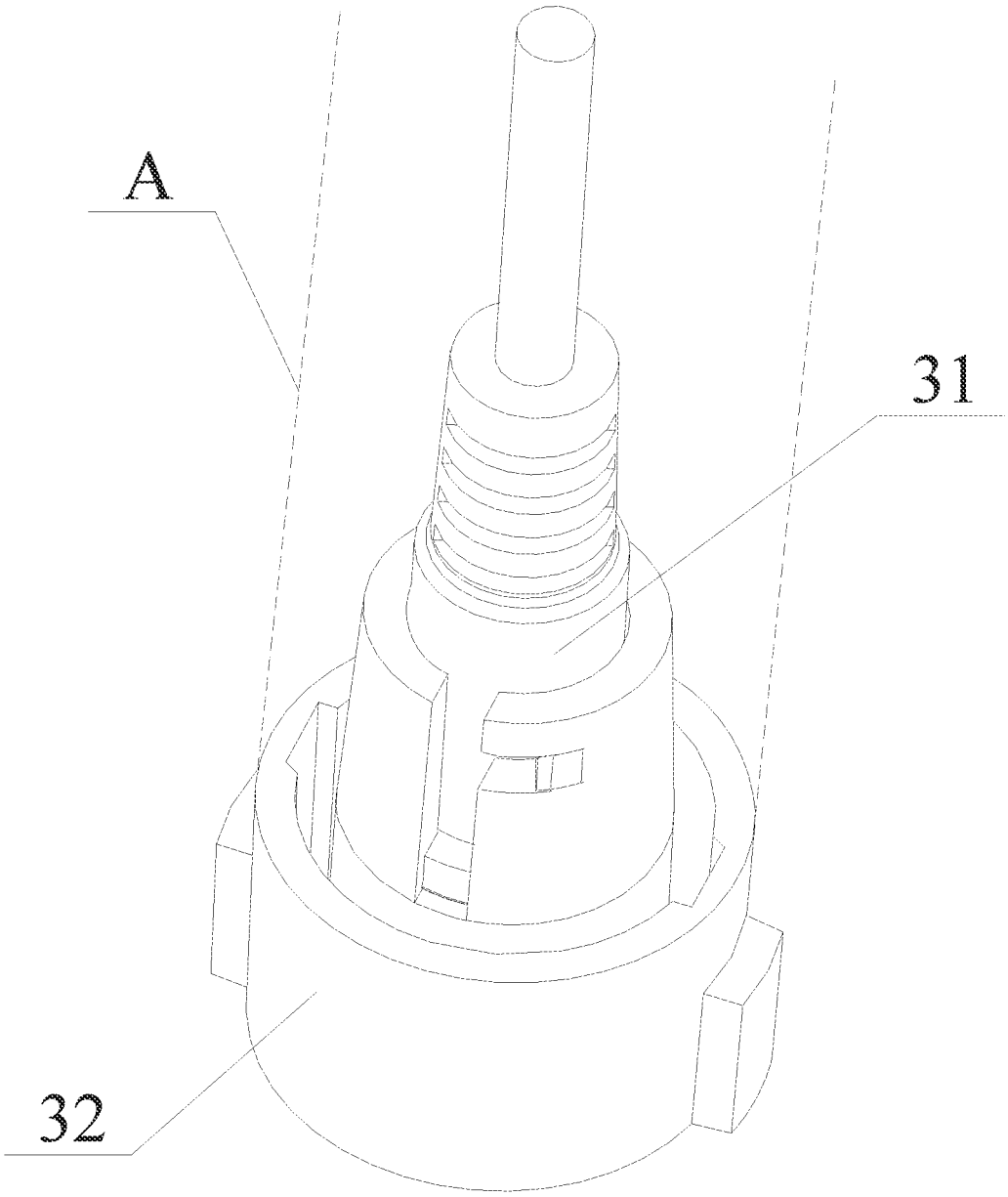
Figure 9:
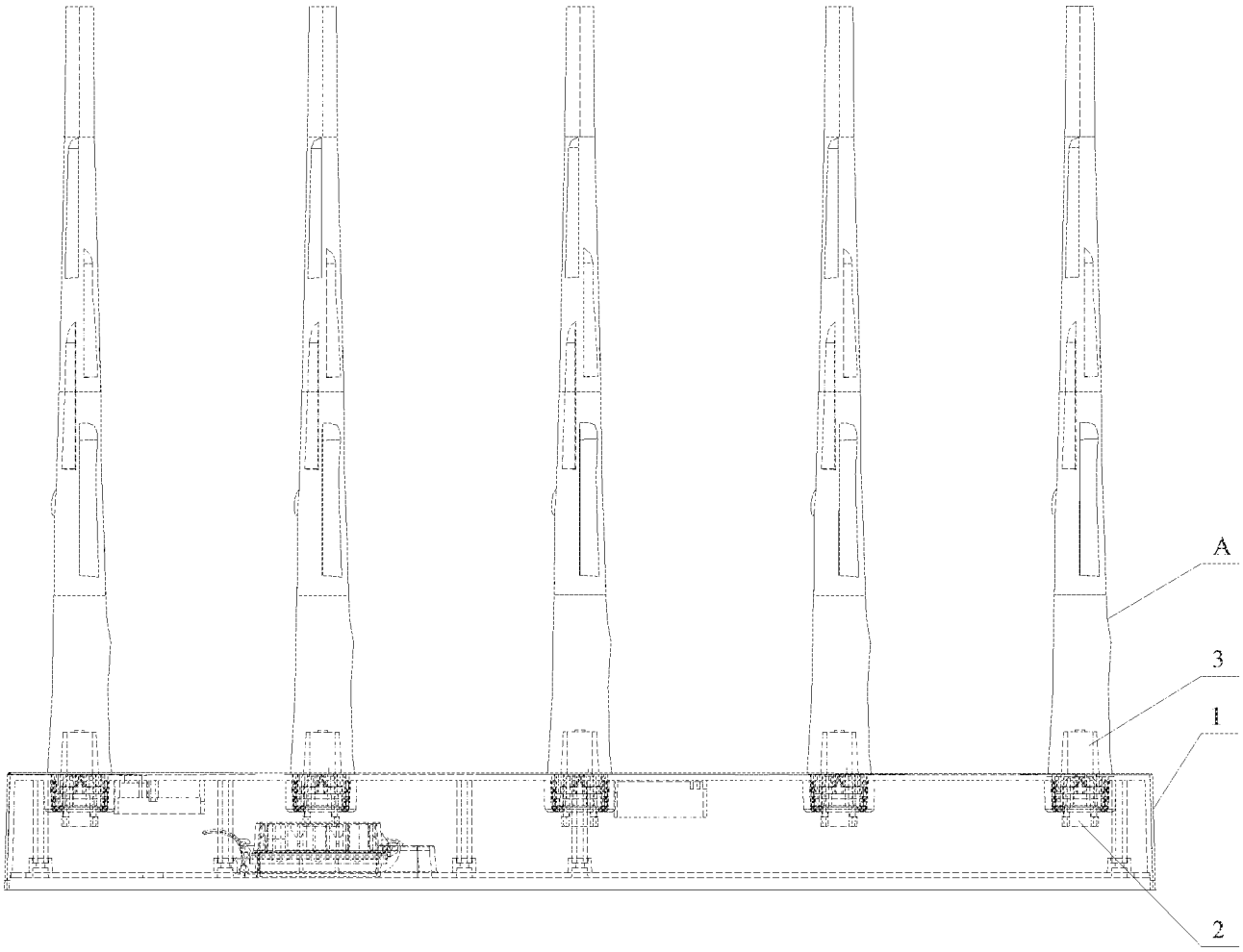

FIG. 1 is a structural schematic diagram of a power supply base for a decorative lamp according to the present invention;

FIG. 2 is a structural schematic diagram of a top surface of a base in a power supply base for a decorative lamp according to the present invention;

FIG. 3 is a structural schematic diagram of an interior of a base in a power supply base for a decorative lamp according to the present invention;

FIG. 4 is a structural schematic diagram of a female plug in a power supply base for a decorative lamp according to the present invention;

FIG. 5 is a structural schematic diagram of a connecting sleeve in a power supply base for a decorative lamp according to the present invention;

FIG. 6 is a structural schematic diagram of a male plug main body in a power supply base for a decorative lamp according to the present invention;

FIG. 7 is a schematic assembling diagram of a female plug, a male plug and a connecting sleeve in a power supply base for a decorative lamp according to the present invention;

FIG. 8 is a schematic mounting diagram of a male plug and a decorative lamp in a power supply base for a decorative lamp according to the present invention; and FIG. 9 is a schematic application diagram of a power supply base for a decorative lamp according to the present invention.

DETAILED DESCRIPTION OF THE EMBODIMENTS

The present invention is described in detail below with reference to the accompanying drawings and embodiments. Each example is provided to explain the present invention instead of limiting the present invention. In fact, those skilled in the art will appreciate that modifications and variations may be made in the present invention without departing from the scope or spirit of the present invention. For example, features shown or described as one part of one embodiment may be applied to another embodiment to generate yet another embodiment. Therefore, it is expected that the present invention includes such modifications and variations that fall within the scope of the appended claims and their equivalents.

In the description of the present invention, orientation or position relationships indicated by terms "longitudinal", "transverse", "upper", "lower", "front", "rear", "left", "right", "vertical", "horizontal", "top", "bottom" and the like are orientation or position relationships shown in the drawings, and these terms are merely for facilitating description of the present invention, but not for requiring that the present invention must be constructed and operated in a specific orientation, and thus, these terms cannot be understood as a limitation to the present invention. As used in the present invention, the terms "connected", "connection" and "set" should be understood in a broad sense, for example, they may be fixed connection or detachable connection, they may be direct connection or indirect connection through an intermediate part; or they may be wired connection and wireless connection, or may be connection through a wireless communication signal. For those of ordinary skill in the field, the specific meanings of the terms may be understood according to the specific conditions.

The accompanying drawings show one or a plurality of examples of the present invention. The detailed description uses reference numerals and letters to refer to the features in the accompanying drawings. Similar numeral references in the drawings and description have been used to refer to the similar parts in the present invention. As used herein, the terms "first", "second" and "third" are used interchangeably to distinguish one component from another component, and are not intended to indicate the position or importance of individual components.

Exemplary embodiments will be described in detail here, and examples thereof are shown in the accompanying drawings. When the following description hereinafter refers to the accompanying drawings, the same reference numerals in different drawings represent the same or similar elements, unless otherwise represented. The implementation manners described in the following exemplary examples do not represent all implementation manners consistent with the present invention. Instead, they are merely examples of devices consistent with some aspects of the present invention as detailed in the appended claims.

In order to solve the problem of exposure of a large number of wires in existing decorative lamps which affects the ornamental effect, and the problem of potential safety hazard caused by the fact that the exposed wires are prone to damage, this embodiment provides a power supply base for a decorative lamp. The power supply base not only can supply power for the decorative lamp, but also can hide wires used by the decorative lamp inside. Specifically, referring to FIG. 1, the power supply base is mainly composed of a base 1, a female plug 2 and a male plug 3, where the base 1 is a base body of the power supply base, the base 1 is composed of an upper shell and a bottom cover, a cavity is formed in an interior of the base 1, referring to FIG. 2, a downward recessed mounting groove 11 is formed in an upper surface of the base 1, a through hole 111 communicating with the cavity of the base 1 is formed in a bottom surface of the mounting groove 11, a panel 12 extending upward is arranged along a circumferential direction of the through hole 111, and a mounting chamber is surrounded by the panel 12. The female plug 2 is mounted in the mounting chamber, and a terminal of the female plug 2 passes through the through hole 111, is located in the cavity of the base 1 and is used for being connected to a power supply. The power supply may be a battery, or may be an external socket. When the power supply is the battery, the battery is directly mounted in the cavity of the base 1. When the power supply is the external socket, it is only necessary to lead a wire out of the cavity of the base 1 for connection. An upper part of the male plug 3 is mounted at the bottom of the decorative lamp, and a lower part of the male plug 3 is movably inserted in the female plug 2 and is electrically connected to the female plug 2, thereby leading out current on the female plug side.

In the power supply base provided by the above embodiment, there may be one or a plurality of mounting grooves 11 on the base 1. When there are a plurality of mounting grooves 11, it is only necessary to set the corresponding number of female plugs 2 and male plugs 3, where the assembling diagram of the female plugs 2 and the male plugs 3 may be referenced to FIG. 7.

According to the power supply base for the decorative lamp provided by the above embodiment, the female plug connected to the power supply through the wire is buried in the base 1, and the connected wires are all hidden in the cavity of the base 1. During use, the male plug 3 can be fixedly mounted at the bottom of the decorative lamp A, referring to FIG. 8. At this time, the upper part of the male plug 3 is located in the cavity of the decorative lamp A, the wire led out of the male plug 3 is directly hidden in the cavity of the decorative lamp, so that the wires are overally hidden, the connecting wire between the female plug 2 and the power supply and the connecting wire between the male plug 3 and the decorative lamp cannot be seen outside the decorative lamp. After the female plug 2 in the base 1 is connected to the power supply to supply power, a plug pin of the male plug 3 is inserted into a jack of the female plug 2, current can be introduced into the decorative lamp side to supply power for the decorative lamp, and the specific use effect may be referenced to FIG. 9. When the decorative lamp is not used, the male plug at the bottom of the decorative lamp is unplugged out of the female plug to realize power failure, or the female plug 2 is powered off.

In order to enhance the firmness of connection between the female plug 2 and the base 1, as an improvement of the technical solution, referring to FIG. 3, a limiting plate 13 extending downward is arranged along a circumferential direction of the through hole 111 on a bottom surface of the mounting groove 11, the limiting plate 13 has a connecting end 131 and a free end 132, first positioning hole channels 14 are symmetrically formed on the limiting plate 13, each of the first positioning hole channel 14 is composed of a first guiding hole channel 141 and a first locking hole channel 142 which communicate with each other, the first guiding hole channel 141 is linear, is arranged along an extending direction of the limiting plate 13, and penetrates through the free end 132 of the limiting plate 13, and the first locking hole channel 142 is arranged vertically relative to the first guiding hole channel 141 and extends along a circumferential direction of the limiting plate 13. To be fitted with the above structure, referring to FIG. 4, first limiting blocks 21 fitted with the first positioning hole channels 14 are symmetrically arranged on an outer side wall of the female plug 2.

By the design of the above structure, during mounting, the first limiting blocks 21 symmetrically arranged on the outer side wall of the female plug 2 are respectively opposite to the two symmetrical first positioning hole channels 14, and continuously move upward along the first guiding hole channels 141 until the first limiting blocks 21 arrives at a position where the first guiding hole channel 141 is connected to the first locking hole channel 142, the female plug 2 rotates along an extending direction of the first locking hole channel 142, and at this time, the first limiting blocks 21 are limited through the first locking hole channel 142, so that the female plug 2 and the base 1 are mounted and locked.

This embodiment provides a specific structure of a female plug 3. The female plug 3 is mainly composed of a female plug main body 31 and a connecting sleeve 32. Referring to FIG. 5, the connecting sleeve 32 includes a connecting part 321 and a locking part 322 which are integrally connected to each other, where the connecting part is a column-shaped cylinder with a closed upper end and an open lower end, a through hole penetrating up and down is formed in a closed end face of the upper end of the connecting part 321, the locking part 322 is a column-shaped cylinder with open upper and lower ends, the locking part 322 and the through hole in the connecting part 321 are coaxially arranged, the lower end of the locking part 322 is fixedly connected to the closed end face of the upper end of the connecting part 321, second positioning hole channels 3221 are symmetrically formed in a side wall of the locking part 322, each of the second positioning hole channels 3221 is composed of a second guiding hole channel 32211 and a second locking hole channel 32212 which communicate with each other, the second guiding hole channel 32211 is linear, is arranged along a height direction of the locking part 322, and penetrates through the upper end of the locking part 322, and the second locking hole channel 32212 is arranged vertically relative to the second guiding hole channel 32211 and extends along the circumferential direction of the locking part 322. To be fitted with the above structure, referring to FIG. 6, second limiting blocks 311 fitted with the second positioning hole channels 3221 are symmetrically arranged on an outer side wall of the male plug main body 31.

By the design of the above structure, during mounting, the second limiting blocks 311 symmetrically arranged on the outer side wall of the male plug main body 31 are respectively opposite to the two symmetrical second positioning hole channels 3221, and continuously move upward along the second guiding hole channels 32211 until the second positioning hole channels 3221 arrive at a position where the second guiding hole channel 32211 is connected to the second locking hole channel 32212, the male plug main body 31 rotates along an extending direction of the second locking hole channel 32212, and at this time, the second limiting blocks 311 are limited through the second locking hole channel 32212, so that the male plug main body 31 and the connecting sleeve 32 are mounted and locked.

To cooperate with the structure of the connecting sleeve 32, as an improvement of the technical solution, referring to FIG. 6, a convex edge 312 extending outward along a radial direction is arranged at the periphery of the male plug main body 31, the convex edge 312 is located between a plug pin of the male plug main body 31 and the second limiting blocks 311, and a diameter of the convex edge 312 is greater than a diameter of the through hole in the closed end face of the upper end of the connecting part 321 and is less than a diameter of the connecting part 321. At this time, the connecting sleeve 32 is sleeved outside the male plug main body 31, and the convex edge 312 just abuts against the closed end face of the upper end of the connecting part 321, thereby improving the sealing property of connection between the connecting sleeve 32 and the male plug main body 31. More preferably, a sealing pad is arranged in an interior of the connecting part 321 in the connecting sleeve 32. When the connecting sleeve 32 is sleeved outside the male plug main body 31, and the sealing pad is just located between the closed end face of the upper end of the connecting part 321 and the convex edge 312 of the male plug main body 31, thereby further improving sealing property.

To improve the waterproof property, as an improvement of the technical solution, referring to FIG. 5, the connecting part 321 in the connecting sleeve 32 is provided with a waterproof edge 3211 extending upwards, thereby preventing water drops from flowing into the mounting groove 11 of the base 1 along the connecting part 321.

The connecting sleeve 32 is mainly used to cooperate with the mounting groove 11 on the base 1, thereby improving the stability of connection between the male plug and the female plug and avoiding shaking or virtual connection. As an improvement of the technical solution, referring to FIG. 5, locking blocks 3212 protruding outward along a radial direction are symmetrically arranged on an outer side wall of the connecting part 321 in the connecting sleeve 32 for matching. Positioning slideways fitted with the locking blocks 3212 are symmetrically arranged on a side wall of the mounting groove 11 in the base 1. Each of the positioning slideways is composed of a guiding slideway and a locking slideway which communicate with each other, the guiding slideway is linear, is arranged along a height direction of the mounting groove 11, and penetrates through an upper edge of the mounting groove 11, and the locking slideway is arranged vertically relative to the guiding slideway and extends along a circumferential direction of the mounting groove 11.

By the design of the above structure, when the connecting sleeve 32 is mounted, the locking blocks 3212 arranged symmetrically on the outer side wall of the connecting part 321 are respectively opposite to the positioning slideways on the side wall of the mounting groove 11, the locking blocks 3212 slide downward along a guiding slideway until arriving at a position where the guiding slideway is connected to the locking slideway, the connecting sleeve 32 rotates along the extending direction of the locking slideway, and the locking blocks 3212 are limited by the locking slideway, thereby realizing stable connection between the connecting sleeve 32 and the mounting groove 11.

After considering the specification and practicing the invention disclosed herein, those skilled in the art would readily conceive of other embodiments of the present invention. This application is intended to cover any variations, uses or adaptive changes of the present invention. These variations, uses or adaptive changes follow the general principle of the present invention and include common general knowledge or conventional technical means in the technical field that are not disclosed in the present invention. The specification and the embodiments are merely regarded as exemplary, and the real scope and spirit of the present invention are indicated by the following claims.

It should be understood that the present invention is not limited to the precise structure described above and shown in the drawings, and various modifications and changes may be made without departing from its scope. The scope of the present invention is limited only by the appended claims. The above is merely illustrative of the preferred embodiments of the present invention and is not intended to limit the present invention, and various changes and modifications may be made by those skilled in the art. Any modifications, equivalent substitutions, improvements, etc. made within the spirit and scope of the present invention should be included within the protection scope of the present invention.

The invention claimed is:

1. A power supply base for a decorative lamp, comprising: a base (1), a female plug (2), and a male plug (3), wherein a cavity is formed in an interior of the base (1), a downward recessed mounting groove (11) is provided in an upper surface of the base (1), a through hole (111) communicating with the cavity of the base (1) is provided in a bottom surface of the mounting groove (11), a panel (12) extending upward is arranged along a circumferential direction of the through hole (111), and a mounting chamber is surrounded by the panel (12);

the female plug (2) is mounted in the mounting chamber, and a terminal of the female plug (2) passes through the through hole (111), is located in the cavity of the base (1) and is used for being connected to a power supply; and an upper part of the male plug (3) is mounted at the bottom of the decorative lamp, and a lower part of the male plug (3) is movably inserted in the female plug (2) and is electrically connected to the female plug (2).

2. The power supply base for the decorative lamp according to claim 1, wherein a limiting plate (13) extending downward is arranged along the circumferential direction of the through hole (111) on a bottom surface of the mounting groove (11), the limiting plate (13) has a connecting end (131) and a free end (132), first positioning hole channels (14) are symmetrically formed on the limiting plate (13), and each of the first positioning hole channels (14) is composed of a first guiding hole channel (141) and a first locking hole channel (142), the first guiding hole channel (141) is linear, is arranged along an extending direction of the limiting plate (13) and penetrates through the free end (132) of the limiting plate (13), and the first locking hole channel (142) is arranged vertically relative to the first guiding hole channel (141) and extends along a circumferential direction of the limiting plate (13); and first limiting blocks (21) fitted with the first positioning hole channels (14) are symmetrically arranged on an outer side wall of the female plug (2).

3. The power supply base for the decorative lamp according to claim 1, wherein the male plug (3) comprises a male plug main body (31) and a connecting sleeve (32);

the connecting sleeve (32) comprises a connecting part (321) and a locking part (322) which are integrally connected to each other;

the connecting part (321) is a column-shaped cylinder with a closed upper end and an open lower end, and a through hole penetrating up and down is formed in a closed end face of the upper end of the connecting part (321);

the locking part (322) is a column-shaped cylinder with open upper and lower ends, the locking part (322) and the through hole in the connecting part (321) are coaxially arranged, the lower end of the locking part (322) is fixedly connected to the closed end face of the upper end of the connecting part (321), second positioning hole channels (3221) are symmetrically formed in a side wall of the locking part (322), each of the second positioning hole channels (3221) is composed of a second guiding hole channel (32211) and a second locking hole channel (32212) which communicate with each other, the second guiding hole channel (32211) is linear, is arranged along a height direction of the locking part (322), and penetrates through the upper end of the locking part (322), and the second locking hole channel (32212) is arranged vertically relative to the second guiding hole channel (32211) and extends along a circumferential direction of the locking part (322); and the male plug main body (31) is embedded in the locking part (322), and second limiting blocks (311) fitted with the second positioning hole channels (3221) are symmetrically arranged on an outer side wall of the male plug main body (31).

4. The power supply base for the decorative lamp according to claim 3, wherein a convex edge (312) extending outward along a radial direction is arranged at the periphery of the male plug main body (31), the convex edge (312) is located between a plug pin of the main plug main body (31) and the second limiting blocks (311), and a diameter of the convex edge (312) is greater than a diameter of the through hole in the end face of the closed end of the connecting part (321) and is less than a diameter of the connecting part (321).

5. The power supply base for the decorative lamp according to claim 4, wherein locking blocks (3212) protruding outward along a radial direction are symmetrically arranged on an outer side wall of the connecting part (321) in the connecting sleeve (32); and positioning slideways fitted with the locking blocks (3212) are symmetrically arranged on a side wall of the mounting groove (11) in the base (1), each of the positioning slideway is composed of a guiding slideway and a locking slideway which communicate with each other, the guiding slideway is linear, is arranged along a height direction of the mounting groove, and penetrates through an upper edge of the mounting groove, and the locking slideway is arranged vertically relative to the guiding slideway and extends along a circumferential direction of the mounting groove.

6. The power supply base for the decorative lamp according to claim 4, wherein a sealing pad is arranged in an interior of the connecting part (321) in the connecting sleeve (32); and when the connecting sleeve (32) is sleeved outside the male plug main body (31), the sealing pad is located between the closed end face of the upper end of the connecting part (321) and the convex edge (312) of the male plug main body (31).

7. The power supply base for the decorative lamp according to claim 3, wherein the connecting part (321) in the connecting sleeve (32) is provided with a waterproof edge (3211) extending upward.

* * * * *